US005819913A

United States Patent [19]

Reiter

[11] Patent Number: 5,819,913

[45] Date of Patent: Oct. 13, 1998

[54] ELECTRIC CIRCUIT ACTUATING MECHANISM

[75] Inventor: John P. Reiter, Richfield, Minn.

[73] Assignee: Reitech Corporation, Burnsville, Minn.

[21] Appl. No.: 747,372

[22] Filed: Nov. 12, 1996

[51] Int. Cl.[6] ..... H01H 3/20

[52] U.S. Cl. ..... 200/332; 200/341; 200/330

[58] Field of Search ..... 200/332, 341, 200/330, 333, 329, 334, 337

[56] References Cited

U.S. PATENT DOCUMENTS

| | | | |
|---|---|---|---|
| 1,045,394 | 11/1912 | Griebe et al. . | |
| 1,376,813 | 5/1921 | Horton | 200/43.16 |
| 1,443,867 | 1/1923 | Burns | 200/50 A |
| 1,706,518 | 3/1929 | Blough . | |
| 1,981,353 | 11/1934 | Getchell | 200/43.16 |
| 1,986,221 | 1/1935 | Sachs | 200/43.16 |
| 2,730,587 | 1/1956 | Feltwell . | |
| 2,824,185 | 2/1958 | Sevey | 200/332 |
| 2,835,771 | 5/1958 | Rausch | 200/334 |
| 2,957,960 | 10/1960 | Ginn . | |
| 2,967,916 | 1/1961 | Williams | 200/44 |
| 3,081,390 | 3/1963 | Lasar . | |
| 3,198,373 | 8/1965 | Ramsing | 200/333 X |
| 3,233,071 | 2/1966 | Bozzell | 200/333 X |
| 3,275,779 | 9/1966 | Roeser | 200/330 |
| 3,312,799 | 4/1967 | Reiter . | |
| 3,576,408 | 4/1971 | Meyerhoefer | 200/330 X |
| 3,681,555 | 8/1972 | Ohkita | 200/332 X |
| 4,166,202 | 8/1979 | Reiter | 200/44 |
| 4,206,328 | 6/1980 | Coyle et al. | 200/44 |
| 4,215,757 | 8/1980 | Repplinger | 200/330 |
| 4,352,967 | 10/1982 | Buchtel | 200/331 |
| 4,389,550 | 6/1983 | Reiter | 200/44 |
| 4,785,144 | 11/1988 | Fosnaugh et al. . | |
| 5,288,958 | 2/1994 | Grunert | 200/43.11 |
| 5,463,196 | 10/1995 | Darimont | 200/43.16 |
| 5,510,587 | 4/1996 | Reiter . | |
| 5,609,244 | 3/1997 | Reiter . | |

FOREIGN PATENT DOCUMENTS

| | | | |
|---|---|---|---|
| 698863 | 10/1940 | Germany | 200/75 |
| 2162372 | 1/1986 | United Kingdom . | |

*Primary Examiner*—David J. Walczak

*Attorney, Agent, or Firm*—Peterson, Wicks, Nemer & Kamrath, P.A.

[57] ABSTRACT

A mechanism (10) for actuating an electric circuit includes a cover (124) having a front wall including a broad surface and movably mounted by pins (126) extending through apertures (108) formed in a mount (90) of a housing (12), with the cover (124) being biased by springs (130) located on the pins (126). Tongues (136) of the cover (124) engage the legs (118) of first and second actuating arms (112, 114) to pivot the arms (112, 114) to pivot an actuation lever (100). The lever (100) includes an actuation finger (104) which pushes against the toggle (38) of a switch (36) to de-energize the circuit. Thus, when any point of the cover (124) is pushed towards the mount (90), the switch (36) is moved to de-energize the circuit. A switch lever (70) is pivotably mounted to the housing (12) and is pivoted by a slideable actuator (42) to move the switch (36) to energize the electric circuit.

21 Claims, 2 Drawing Sheets

ELECTRIC CIRCUIT ACTUATING MECHANISM

BACKGROUND

This invention relates generally to a safety device for power tools and more specifically to an electric circuit actuating mechanism which when appropriately mounted on a power tool stand, allows the operator to turn on the tool's drive motor by a conscious depression of a relatively small sized actuator, but permits the motor to be turned off by depression of a relatively broad surface by a body part and especially by a body part other than the hands of the operator whereby there is no need for the operator to take his eyes or hands off the work and the cutting or abrading tool.

U.S. Pat. Nos. 3,312,799; 4,166,202; and 4,389,550 each describe various forms of switch actuating mechanisms including a broad surface panel member of one type or another pivotally mounted in proximity to the operator's station and this member is mechanically linked to the on/off lever of the toggle switch. Once the motor of the tool is turned on, it may be turned off by bumping the broad surface panel member with one or more parts of the operator's anatomy other than his hands and this operation may be accomplished without having to glance away from the working surface of the tool being used. This, of course, leads to greater safety by preventing accidental or inadvertent movement of the workpiece or hands into a position where they may be injured by the tool.

However, it can be appreciated that due to the hinged mounting of the broad surface in U.S. Pat. Nos. 3,312,799; 4,166,202; and 4,389,550, bumping the broad surface member along the edge adjacent and parallel to the pivot axis as well as adjacent to the pivot axis may not cause the broad surface member to pivot and cause actuation of the switch or result in turning off the motor of the tool. Although other manners of mounting the broad surface members are known such as shown in U.S. Pat. No. 3,233,071, while reducing the possibility that pushing the broad surface member would not cause actuation of the switch, such arrangements did not eliminate the possibility.

U.S. Pat. No. 5,510,587 describes a form of switch actuating mechanism including a broad surface panel member which overcomes deficiencies of the prior art by enabling any point of the broad surface to move in an actuation direction to de-energize the electric circuit. Specifically, the construction of U.S. Pat. No. 5,510,587 utilizes a multiplicity of de-energizing momentary switches which operate a control relay. It can then be appreciated that the control relay and the electric circuit associated therewith as well as the costs of the momentary switches themselves increase the price of the electric circuit actuating mechanism to limit its marketability to industrial and similar commercial applications.

Further, the fabrication of prior actuating mechanisms tended to be overly costly to manufacture because of the number of parts involved and the difficulty of assembly, making it somewhat difficult to market at a price commensurate with the cost of the tool on which the safety mechanism was adapted to be used.

The present invention according to the preferred teachings provides an electric circuit actuating mechanism of the general type described but is designed to be substantially less complicated in terms of the number and cost of parts and their assembly into a completed article. This has been done while increasing the element of safety for which the earlier devices were designed.

Specifically, the present invention solves problems encountered by prior mechanisms in the field of electric circuit actuation and other needs in the field by providing, in the most preferred form, a front wall movably mounted relative to a housing enabling any point of the front wall to move in an actuation direction and an actuation member movable from a rest position towards a de-energizing position when any point of the broad surface moves in the actuation direction from its normal position to its actuation position, with the actuation member being in operative relation to de-energize the electric circuit when the actuation member is moved from the rest position to the de-energizing position, with the electric circuit not being energized by movement of the front wall.

It is accordingly the principal object of the present invention to provide a new and improved safety device for use in conjunction with electrical motor-driven power tools or the like.

Another object of the invention is to provide an electric circuit actuating mechanism for use with electrically powered tools and disposed such that the power may be turned on by the depression of a relatively small surface of an actuator and turned off through the application of a force against a broad surface.

Yet another object of the invention is to provide an improved safety device for the control of power-driven tools, the safety device including a broad surface movably mounted to a housing which, in turn, is arranged to be connected at a desired location on a power tool stand whereby the operator's knee, thigh, hip or other part of his anatomy other than his hands may be used to disconnect the power tool from its power supply.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
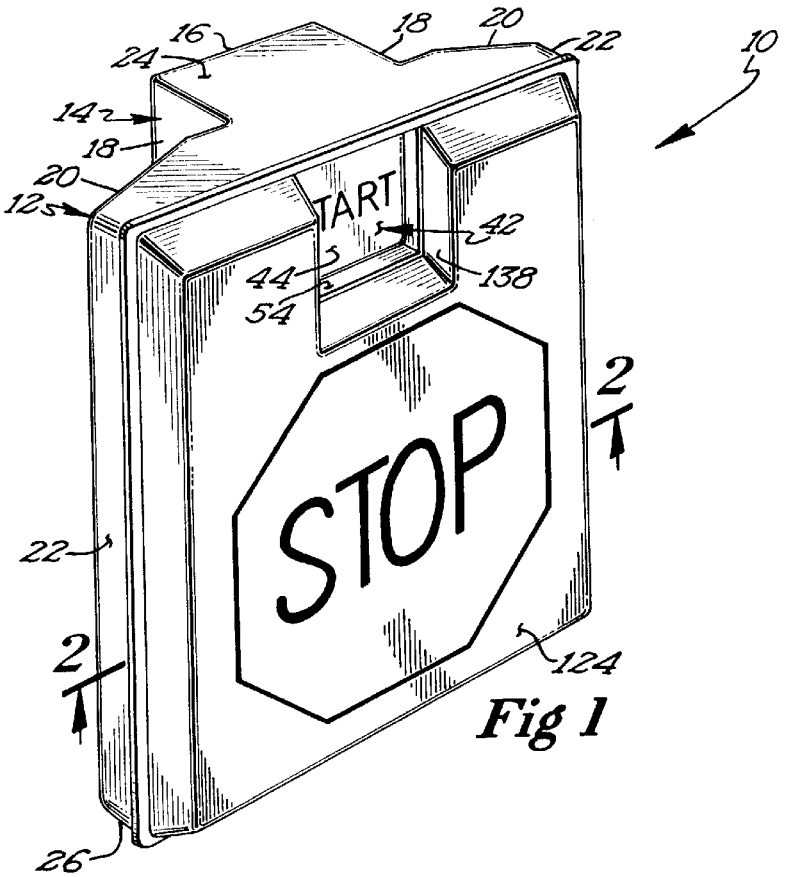
FIG. 1 shows a perspective view of an electric circuit actuating mechanism according to the preferred teachings of the present invention.
Figure 2:
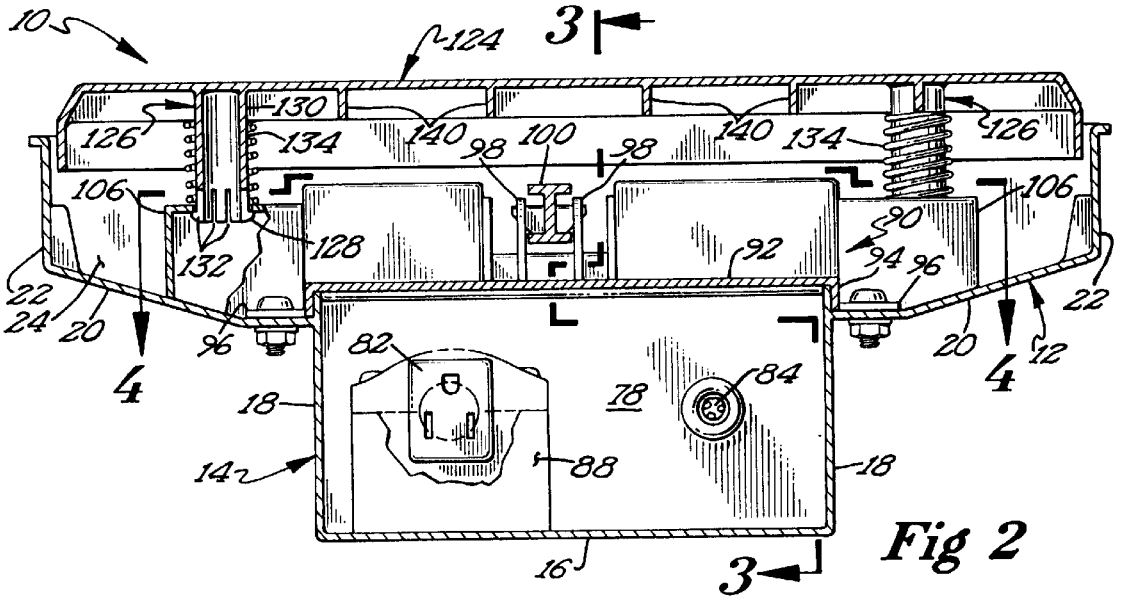
FIG. 2 shows a cross-sectional view of the electric circuit actuating mechanism of FIG. 1 according to section line 2—2 of FIG. 1, with portions broken away and shown in phantom to show constructional features.

All figures are drawn for ease of explanation of the basic teachings of the present invention only; the extensions of the figures with respect to number, position, relationship, and dimensions of the parts to form the preferred embodiment will be explained or will be within the skill of the art after the following description of the preferred embodiment has been read and understood. Further, the exact dimensions and dimensional proportions to conform to specific force, weight, strength, and similar requirements will likewise be within the skill of the art after the following description of the preferred embodiment has been read and understood.

Where used in the various figures of the drawings, the same numerals designate the same or similar parts. Furthermore, when the terms "top", "bottom", "first", "second", "inside", "outside", "front", "back", "outer", "inner", "upper", "lower", "height", "width", "length", "send", "side", "horizontal", "vertical", "rear", and similar terms are used herein, it should be understood that these terms have reference only to the structure shown in the drawings as it would appear to a person viewing the drawings and are utilized only to facilitate describing the preferred embodiment.

DESCRIPTION

An electric circuit actuating mechanism according to the preferred teachings of the present invention is shown in the drawings and generally designated 10. Mechanism 10 generally includes a housing 12. In the preferred form, housing 12 includes a channel 14 including a planar bottom 16 and first and second planar sides 18 extending generally perpendicularly from the opposite side edges of bottom 16. Housing 12 further includes first and second extensions 20 extending from and outwardly of sides 18. Extensions 20 terminate in first and second planar side walls 22 extending generally parallel to sides 18. An upper end wall 24 extends generally perpendicular between bottom 16, sides 18, extensions 20, and side walls 22. A lower end wall 26 extends generally perpendicular between extensions 20 and side walls 22, with the lower end of channel 14 being open.

Housing 12 further includes an L-shaped divider 28 having a first plate 30 and a second plate 32 extending generally perpendicular to first plate 30. Plate 30 has a width for slideable receipt between sides 18 and a height generally equal to sides 18. Plate 32 has a width of a size for abutting with the top edges of sides 18 and a length extending from plate 30 to upper end wall 24 parallel to bottom 16 of channel 14. Suitable slides 34 can be formed on sides 18 and bottom 16 for slideable receipt of plate 30. A toggle switch 36 is mounted to plate 30 having a toggle 38 extending from plate 30 in the same direction as plate 32 and a body 40 located on the opposite side of plate 30 than plate 32. Toggle 38 is movable between an on position and an off position, with switch 36 in the on position maintaining the electric circuit and in the off position breaking the electric circuit.

Mechanism 10 further includes a generally U-shaped actuator 42 having a planar front 44 and first and second legs 46 extending in a spaced parallel relation from the back surface of front 44. Actuator 42 is slideably mounted to plate 32 such as by legs 46 extending through parallel first slots 48 extending from the free edge of plate 32 towards plate 30. In the preferred form, parallel second slots 50 extend from the free edge of plate 32 towards plate 30 parallel to and intermediate slots 48. An ear 52 extends into each of slots 48 adjacent the free edge of plate 32 and extending in a direction opposite to slots 50. Ears 52 abut with the top edge of a slot formed in the upper edges of legs 46. It can then be appreciated that the material of plate 32 between slots 48 and 50 can be flexed sufficiently to allow insertion of legs 46 in slots 48 past ears 52 but will return so that ears 52 capture legs 46 in slots 48 after insertion. A U-shaped actuator guide 54 integrally extends from plate 32 adjacent its free edge and in a direction opposite to plate 30. Guide 54 has a size and shape for slideably receiving front 44 of actuator 42.

Figures 3, 4, 5:
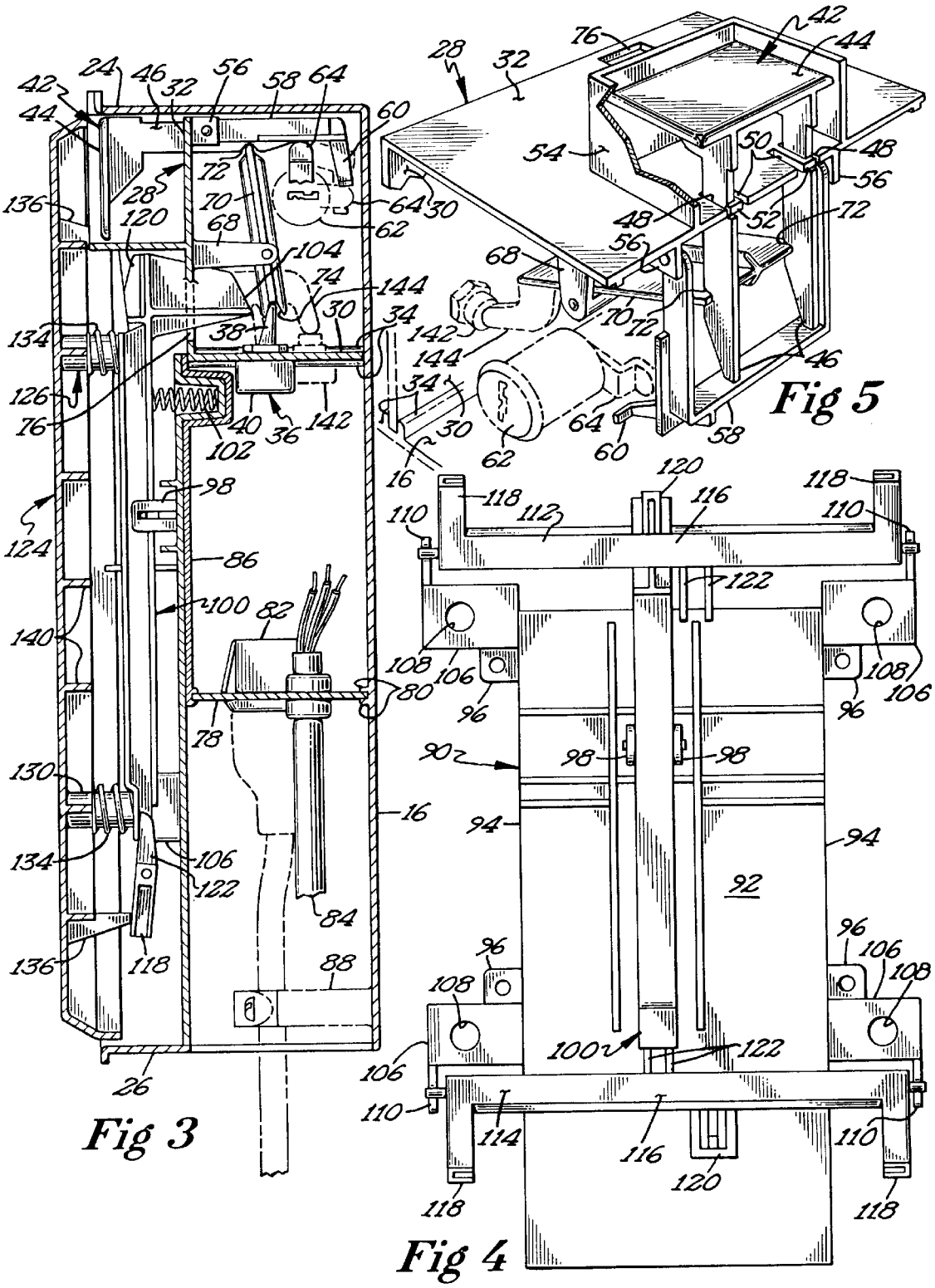
FIG. 3 shows a cross-sectional view of the electric circuit actuating mechanism of FIG. 1 according to section line 3—3 of FIG. 2, with portions broken away and shown in phantom to show constructional features.
FIG. 4 shows a partial, cross-sectional view of the electric circuit actuating mechanism of FIG. 1 according to section line 4—4 of FIG. 2.
FIG. 5 shows a partial, perspective view of the electric circuit actuating mechanism of FIG. 1, with portions shown in phantom to show constructional features.

First and second parallel ears 56 integrally extend from plate 32 opposite to guide 54 and on opposite sides of slots 48. A U-shaped bracket 58 is pivotally mounted to ears 56. Bracket 58 is pivotable between a locked or interfering position extending from ears 56 generally parallel to the slideable movement of actuator 42 and an unlocked or non-interfering position. Bracket 58 includes an L-shaped cam leg 60 integrally extending therefrom. A lock 62 of a commercial variety is mounted to one of sides 18 and includes a latch 64 extending in a non-parallel angle to the rotation axis of lock 62 and located intermediate cam leg 60 and bracket 58. Thus, rotation of lock 62 causes latch 64 to rotate bracket 58 between the locked and unlocked positions. In the locked position as best seen in FIG. 5, the free ends of legs 46 of actuator 42 in its outer, non-actuated position terminate in channel 14 and abut with bracket 58 to prevent actuator 42 from being slid inward from its non-actuated position. In its unlocked position, bracket 58 is in a non-interfering position with actuator 42 and actuator 42 is free to slide relative to plate 32 to its actuated position. For ease of assembly, a detent can be formed in one of ears 56 or bracket 58 for slideable receipt in an indent formed in the other of ears 56 or bracket 58 to hold bracket 58 in its locked position during assembly of mechanism 10.

Third and fourth elongated parallel ears 68 integrally extend from plate 32 opposite to guide 54 and intermediate ears 56 and plate 30. A switch lever 70 is pivotally mounted between ears 68 intermediate its upper and lower ends. Switch lever 70 is suitably connected to actuator 42 so that slideable movement of actuator 42 causes pivotal movement of switch lever 70. In the preferred form, slots 72 are formed in the lower edges of legs 46 of actuator 42 for slideably and pivotably receiving the upper end of switch lever 70. The lower end of switch lever 70 is suitably connected to switch 36 or similar electric control so that pivotal movement of switch lever 70 causes switch 36 to move between its actuated and non-actuated position. Lever 70 is in a suitable operative relation to switch 36 and in the preferred form, a fork 74 is formed on the lower end of switch lever 70 for slideably and pivotably receiving the free end of toggle 38 of switch 36. With actuator 42 in its outer, non-actuated position as shown in FIGS. 3 and 5, switch lever 70 holds toggle 38 of switch 36 in its non-actuated position. Plate 32 includes an opening 76 formed intermediate guide 54 and plate 30 and generally aligned with switch lever 70.

Housing 12 further includes a planar divider 78 having a width for slideable receipt between sides 18 and a height generally equal to sides 18. Suitable slides 80 can be formed on sides 18 and bottom 16 for slideable receipt of divider 78. A female electrical outlet 82 is mounted to divider 78. Also an electrical cord 84 including a suitable strain relief extends through divider 78. Suitable electrical connection is made between switch 36, outlet 82, and electrical cord 84 inside of channel 14 intermediate plate 30 and divider 78. A suitable dust cover 86 is provided to close the top opening of channel 14 intermediate plate 30 and divider 78. A suitable cord clamp 88 is provided in channel 14 on the opposite side of divider 78 than divider 28. Specifically, an electrical cord as shown in phantom in FIG. 3 and having a male electrical outlet for connection to outlet 82 can be removably secured by clamp 88 to prevent unintentional removal from mechanism 10.

Mechanism 10 further includes a mount 90 having a generally U-shape and generally including a generally planar top plate 92 and first and second side plates 94 extending generally perpendicular from the opposite side edges of plate 92. Plate 92 has a width generally equal to and for abutting with the top edges of sides 18 and has a length extending from lower end wall 26 to plate 30. Side plates 94 are slideably received on the outside surfaces of sides 18 and have lower edges which abut with the upper surfaces of extensions 20. Ears 96 are integrally formed on side plates 94. Suitable provisions are made to removably secure ears 96 to extensions 20 such as bolts secured to ears 96 and extending through suitable apertures formed in extensions 20, with nuts threadably received on the bolts and abutting with the opposite sides of extensions 20 than ears 96. It should be noted that dividers 28 and 78 and cover 86 are snapped or slid in place without other forms of securement for ease of assembly, with the securement of mount 90 abutting with and preventing disassembly of dividers 28 and 78 and cover 86 as they are sandwiched between mount 90 and bottom 16 of channel 14.

First and second parallel ears 98 extend from the upper surface of mount 90 opposite sides 18 and intermediate plate 30 and divider 78. An actuation lever 100 is movably mounted relative to housing 12 and specifically is pivotally mounted between ears 98 intermediate its upper and lower ends for movement between a normal or rest position and an actuation or de-energizing position. Lever 100 is biased from the actuation position to the normal position such as by a spring 102 located between lever 100 and mount 90 and located intermediate the upper end of lever 100 and ears 98. An actuation finger 104 integrally extends from adjacent the upper end of lever 100 and through opening 76 for engaging with toggle 38 and/or switch lever 70 adjacent fork 74. Finger 104 engages lever 70 when switch 36 is in its actuated position and lever 100 is in its normal position. Thus, finger 104 operatively relates lever 100 and switch 36 to de-energize the electric circuit when lever 100 is moved from the normal position to the actuation position.

Upper and lower, spaced protuberances 106 are integrally secured to each side plate 94 and to ears 96 also integrally secured thereto. In the most preferred form, protuberances 106 are in the form of hollow rectangular parallelepipeds having open bottoms. Each protuberance 106 includes an aperture 108 and a pivot ear 110.

Mechanism 10 further includes upper and lower actuation arms 112 and 114 pivotably mounted to and between ears 110 about axes which are parallel to but spaced from the axis of actuation lever 100. Actuation arms 112 and 114 are generally U-shaped and each include an elongated central portion 116 extending parallel to the pivot axis of arms 112 and 114 and each further including first and second legs 118 extending perpendicularly from central portions 116. Upper actuator arm 112 includes a tab 120 which abuts with the upper end of lever 100 in its normal position and with legs 118 extending from portion 116 generally parallel to or at a slight angle upward from top plate 92. It should be appreciated that if one or both legs 118 of arm 112 are pushed to pivot actuator arm 112 so that the free ends of legs 118 move toward extensions 20, tab 120 pushes the upper end of lever 100 towards plate 32 and causes lever 100 to pivot from its normal position to its actuation position. Similarly, lower actuator arm 114 includes a tab 122 which abuts with the lower end of lever 100 in its normal position and with legs 118 extending from portion 116 generally parallel to or at a slight angle upward from top plate 92. It should be appreciated that if one or both legs 118 of arm 114 are pushed to pivot actuator arm 114 so that the free ends of legs 118 move toward extensions 20, tab 122 pushes the lower end of lever 100 away from plate 92 and causes lever 100 to pivot from its normal position to its actuation position. In its most preferred form, arms 112 and 114 are of identical construction to reduce fabrication costs and specifically include both tabs 120 and 122, only one of which is utilized depending upon whether utilized as upper or lower arm 112 and 114.

Mechanism 10 according to the teachings of the present invention further includes a cover 124 movable relative to housing 12 and having a front wall including a broad surface. Four pins 126 integrally extend from the rear surface of cover 124 at locations for slideable receipt in apertures 108 of protuberances 106. In the most preferred form, pins 126 have heads 128 formed on the free end of stems 130, with stems 130 having a cross sectional size equal to and for slideable receipt in apertures 108 while heads 128 have an enlarged cross sectional size larger than apertures 108. Heads 128 each include a plurality of axially extending, circumferentially spaced slots 132 which allow heads 128 to be compressed to a size allowing assage through apertures 108 but preventing undesired removal after insertion. Cover 124 is biased away from mount 90 in the preferred form by coil springs 134 positioned on pins 126 and sandwiched intermediate the ear surface of cover 124 and the front surface of protuberances 106. Pins 126 and springs 134 are arranged in a non-linear manner.

Four tongues 136 integrally extend from the rear surface of cover 124 at locations corresponding to and for abutment with legs 118 spaced from central portions 116. Thus, actuation arms 112 and 114 are in operative relation to lever 100 and also to cover 124 for moving lever 100 from its rest position towards its de-energizing position when any point of the broad surface of cover 124 moves in the actuation direction from the normal position to the actuation position.

In the most preferred form, cover 124 includes a cutout 138 extending from its upper edge for extending around guide 54 of housing 12. In the most preferred form of the present invention, the back surface of cover 124 includes a network of ribs 140. It can then be appreciated that ribs 140 increase the strength of cover 124 allowing its formation from reduced thickness materials.

Housing 12 is preferably fabricated from sheet metal or plastics, as is conventional for electrical switch boxes, with mechanism 10 generally fabricated from plastics in the most preferred form.

Now that the details of the construction of mechanism 10 according to the preferred teachings of the present invention have been set forth, consideration will be given to its mode of operation and advantages. As has already been mentioned, the present invention comprises a safety device in the form of electric circuit actuating mechanism 10 for facilitating the control of electrical circuits such as for drive motors or the like commonly used with power tools. For example, the present invention may be used with a wide variety of power tools including table saws, drill presses, lathes, sanders, joiner/planers and the like. Mechanism 10 is mounted at a convenient location proximate the operator's usual work station and power is brought into housing 12 through electric cord 84. The electrical cord for the power tool or the like is plugged into outlet 82 and secured by clamp 88. Due to the solid construction of housing 12 and specifically channel 14, dividers 28 and 78 and dust cover 86 thereof, the interior defined by housing 12 in the most preferred form encloses the electrical components of switch 36, outlet 82, and the electric connections therebetween and with cord 84 and protects them from the environment such as but not limited to sawdust and the like which may be in the air.

To start the motor, the operator must first unlock mechanism 10 by rotating the key for lock 62. The operator may now depress planar front 44 of actuator 42 to move switch 36 from its off position to its on position to maintain a closed circuit between the power supply and the motor being controlled. It can then be appreciated that actuation of switch 36 does not occur as the result of movement of cover 124.

All the while, the machine can be running in that switch 36 effected an energization of the electric circuit. When the operator desires to again turn off the motor, he may apply a force either with his hand, but preferably with another part of his anatomy such as his thigh, knee or hip, against the broad front surface of cover 124 to thereby overcome the force of one or more of coil springs 134 and force cover 124 against one or more of legs 118 of arms 112 and/or 114. Depression of cover 124 against legs 118 then causes one or both of arms 112 and 114 to pivot such that switch 36 is moved from its on position to its off position. With switch 36 in its off position, the electrical connection to the motor is broken, disconnecting the motor from the power supply. When cover 124 is released, coil springs 134 return it to its normal position while springs 102 associated with lever 100 ensure that lever 100 and arms 112 and 114 will also be returned to their de-energizing position.

It can then be appreciated that de-energization of the electric circuit can be accomplished by pushing cover 124 in different manners. Specifically, in the preferred form, as one or more pins 126 can slide through apertures 108 relative to mount 90 against the bias of springs 134, cover 124 is movably mounted relative to housing 12 enabling any point of the broad surface of cover 124 to move in an actuation direction from the normal position to the actuation position, with the front wall being biased from the actuation position to the normal position by springs 134. Particularly, cover 124 can be pushed to move cover 124 adjacent to upper end wall 24 towards housing 12 causing cover 124 to pivot about an axis parallel and adjacent to lower end wall 26 in a similar manner as in U.S. Pat. No. 4,389,550. It can be appreciated that the portions of cover 124 adjacent to side walls 22 will move in a non-parallel manner relative to side walls 22. Such movement of cover 124 will pivot arm 112 which in turn pushes the upper end of lever 100 towards housing 12 to thus de-energize the electric circuit. However, unlike U.S. Pat. No. 4,389,550, cover 124 can be pushed to move cover 124 adjacent to lower end wall 26 towards housing 12 causing cover 124 to pivot about an axis parallel and adjacent to upper end wall 24. It can be appreciated that the portions of cover 124 adjacent to side walls 22 will move in a non-parallel manner relative to side walls 22. Such movement of cover 124 will pivot arm 114 which in turn pushes the lower end of lever 100 away from housing 12 to thus de-energize the electric circuit. Furthermore, unlike U.S. Pat. No. 4,389,550, cover 124 can be pushed to move cover 124 adjacent to one of the first and second side walls 22 towards housing 12 causing cover 124 to pivot about an axis parallel to and adjacent the other of the first and second side walls 22. It can be appreciated that the portions of cover 124 adjacent to end walls 24 and 26 will move in a non-parallel manner relative to end walls 24 and 26. Such movement of cover 124 will simultaneously pivot arms 112 and 114 which in turn pivot lever 100 so that its upper end moves towards housing 12 and the lower end moves away from housing 12 to thus de-energize the electric circuit. Further, unlike U.S. Pat. No. 4,389,550, cover 124 can be pushed towards housing 12 adjacent to the upper right corner causing cover 124 to pivot about an axis extending between the left side wall 22 and end wall 26. It can be appreciated that the remaining portions of cover 124 will move in a non-parallel manner from the remaining portions of housing 12. Such movement of cover 124 will engage the right leg 118 of arm 112 to pivot arm 112 which in turn pivots the upper end of lever 100 towards housing 12 to thus de-energize the electric circuit. Similarly, cover 124 can be pushed adjacent its other corners to thereby move switch 36 from its on position to its off position.

It can then be appreciated that the positioning of the body part other than the hand such as thigh, knee, or hip on cover 124 is not as accurate as a hand would be, especially when cover 124 is not being viewed and even further under emergency situations where fast actuation is desired. Mechanism 10 then provides a substantial improvement over mechanisms including actuation surfaces which are pivotally mounted through the use of a hinged mounting such as in U.S. Pat. Nos. 3,312,799; 4,166,202; and 4,389,550 in the ability to quickly and consistently de-energize the electric circuit. Furthermore, the present invention provides a substantial improvement over mechanisms including actuating surfaces which are not mounted through the use of hinge mountings such as in U.S. Pat. No. 3,233,071. Specifically, such mechanisms were not consistent in causing actuation of the switch. For example, in some circumstances, the surface would bottom out by hitting other portions of the mechanism before actuating the switch. Further, considerable travel of the surface would be required especially when pushed at the corner before the switch was actuated, and similarly considerable force would be required in these circumstances especially if a typical start/stop type switch was utilized. Mechanism 10 according to the teachings of the present invention then takes a novel and unique design direction from prior mechanisms such as shown in U.S. Pat. No. 3,233,071. Specifically, lever 100 and arms 112 and 114 are utilized such that the amount of travel of cover 124 and the amount of force to push cover 124 required to actuate switch 36 are minimized. But more importantly, the use of lever 100 and arms 112 and 114 allows the use of one start/stop type switch 36 to be possible and practical. It can then be appreciated that lever 100 and arms 112 and 114 according to the teachings of the present invention allow different movements of cover 124 to actuate switch 36 especially if movement occurs at the corners of a generally right parallelepiped-shaped mechanism 10 in the most preferred form. Thus, mechanism 10 according to the teachings of the present invention effectively eliminates the possibility that pushing cover 124 will not cause actuation of switch 36 causing de-energization of the electric circuit and overcomes the disadvantages and limitations of prior mechanisms including but not limited to the types as shown in U.S. Pat. Nos. 3,233,071; 3,312,799; 4,166,202; and 4,389,550.

To lock actuating mechanism 10 and to thereby prevent unauthorized use of the power tool, the operator turns the key for lock 62 which prevents actuator 42 from sliding and removes the key.

By making front 44 relatively small and by recessing front 44 behind the front surface of cover 124, accidental operation of switch 36 is practically eliminated. It of course can be appreciated that actuator 42 can be located at other positions in housing 12 or other manners can be utilized to energize the electric circuit according to the teachings of the present invention as long as movement of switch 36 from its off position or energization of the electric circuit does not occur as the result of the movement of cover 124. Once switch 36 is operated to turn the machine on, the operator need not search around for an off switch in that application of a force anywhere on cover 124 functions to turn off the machine.

It can then be appreciated that cover 124 formed by walls defining a sleeve which telescopes inside of walls 22, 24, and 26 is believed to be advantageous in making disassembly more difficult. Specifically, if cover 124 were telescoped on the outside of housing 12 such as disclosed in U.S. Pat. No. 3,233,071, the back edges of the cover could be easily flexed outwardly to release the cover from the housing, with such flexing being the result of an object accidentally catching on the back edges or by simply being gripped by the fingers of a vandal which can be a significant problem in a school or similar environment. Due to the construction of mechanism 10 according to the preferred teachings of the present invention, disassembly requires the securement of mount 90 to be removed from extensions 20 allowing access to heads 128, which is very time consuming and also very difficult to perform especially when mechanism 10 is mounted on the work station.

Now that the basic teachings of the present invention have been explained, many extensions and variations will be obvious to one having ordinary skill in the art. For example, although in the most preferred form, a single switch 36 is utilized to both energize and de-energize the electric circuit, the electric circuit could be separately energized and de-energized. In this regard, a second switch 142 shown in phantom in FIGS. 3 and 5 could be provided to de-energize the electric circuit. In this regard, switch 142 could be actuated by a protuberance 144 formed on switch lever 70 in the form shown and/or secured to actuation finger 104. Likewise, switches 36 and/or 142 could be of the momentary type, with switch 142 shown in the preferred form of the momentary type.

Likewise, although outlet 82 and cord 84 are shown in the preferred form mounted to divider 78, divider 78 according to the teachings of the present invention could include knockouts for passage of electric lines so that switches 142 and/or 36 or other electric controls provided in mechanism 10 can be directly wired between the source of power and the power tool or the like being controlled.

Further, although cover 124 is movably mounted to housing 12 by a multiplicity of pins 126 sliding through apertures 108 and positioning springs 134 between cover 124 and housing 12 in the preferred form, other manners of movably mounting cover 124 relative to housing 12 and which enables any point of the broad surface to move in the actuation direction can be utilized including but not limited to springs or other biasing members spaced from pins 126, the construction shown in U.S. Pat. No. 5,510,587, or the like.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

I claim:

1. Mechanism for actuating an electric circuit comprising, in combination: a housing; a front wall having a broad surface; means for movably mounting the front wall relative to the housing in an actuation direction from a normal position to an actuation position, with the front wall being biased from the actuation position to the normal position;

at least a first switch mounted to the housing; an actuation member movably mounted relative to the housing between a rest position and a de-energizing position, with the actuation member being biased to move from its de-energizing position to its rest position, with the actuation member being in operative relation to de-energize the electric circuit when the actuation member is moved from the rest position to the de-energizing position; and means in operative relation to the actuation member and the front wall for moving the actuation member from the rest position towards the de-energizing position when the front wall moves in the actuation direction from the normal position to the actuation position, with the energizing of the electric circuit not occurring as the result of the movement of the front wall.

2. The electric circuit actuating mechanism of claim 1 wherein the actuation member is pivotally mounted to the housing about a pivot axis for pivotal movement between the rest position and the de-energizing position; and wherein the moving means pivots the actuation member when any point of the broad surface moves in the actuation direction.

3. The electric circuit actuating mechanism of claim 2 wherein the actuation member is pivotally mounted to the housing intermediate first and second ends, with the first end moving towards the housing and the second end moving away from the housing when the actuation member is pivoted from the rest position to the de-energizing position.

4. The electric circuit actuating mechanism of claim 3 wherein the moving means comprises, in combination: first and second actuation arms pivotally mounted to the housing about spaced axes parallel to and spaced from the pivot axis of the actuation member, with each of the actuation arms including first and second legs extending therefrom for engaging with the front wall and a tab for engaging with the actuation member.

5. The electric circuit actuating mechanism of claim 4 wherein the first and second actuation arms are of identical construction.

6. The electric circuit actuating mechanism of claim 2 wherein the actuation member is biased by a spring extending between the actuation member and the housing.

7. The electric circuit actuating mechanism of claim 1 wherein the movably mounting means comprises, in combination: a multiplicity of coil springs which are arranged in a non-linear manner and sandwiched between the housing and the front wall.

8. The electric circuit actuating mechanism of claim 7 wherein the movably mounting means further comprises, in combination: a multiplicity of pins extending from the front wall and slideably received in apertures formed in the housing, with the coil springs positioned around the pins.

9. The electric circuit actuating mechanism of claim 1 wherein the switch is a toggle switch movable between an on position and an off position, with the switch moving from the on position to the off position when the front wall moves from the normal position to the actuation position; and wherein the electric circuit actuating mechanism further comprises, in combination: means for moving the switch from the off position to the on position comprising, in combination: a switch lever pivotally mounted to the housing and in operative relation to the switch; and means for pivoting the switch lever relative to the housing.

10. The electric circuit actuating mechanism of claim 9 wherein the pivoting means comprises an actuator slideably mounted to the housing for movement between an actuated position and a non-actuated position, with the switch lever being pivotally connected to the actuator, with the switch lever moving the switch from the off position to the on position when the actuator moves from the non-actuated position to the actuated position.

11. The electric circuit actuating mechanism of claim 8 further comprising, in combination: means for preventing the actuator from moving from the non-actuated position comprising, in combination: a bracket pivotally mounted to the housing for movement between an interfering position and a non-interfering position, with the actuator in the non-actuated position abutting with the bracket in the interfering position and being free to move when the bracket is in the non-interfering position.

12. The electric circuit actuating mechanism of claim 1 wherein the moving means comprises, in combination: first and second actuation arms pivotally mounted to the housing, with each of the actuation arms including first and second legs extending therefrom for engaging with the front wall and a tab for engaging with the actuation member.

13. The electric circuit actuating mechanism of claim 12 wherein the first and second actuation arms are of identical construction.

14. The electric circuit actuating mechanism of claim 1 wherein the housing comprises, in combination: a channel having first and second planar sides extending from a bottom; and a first divider slideably received between the first and second planar sides and abutting with the bottom of the channel, with the first switch mounted to the first divider.

15. The electric circuit actuating mechanism of claim 14 wherein the housing further comprises, in combination: a second divider slideably received between the first and second planar sides and abutting with the bottom of the channel; and wherein the electric circuit actuating mechanism further comprises, in combination: an electric cord extending through the second divider and terminating in the channel intermediate the first and second dividers; and an electrical outlet mounted to the second divider; and wherein the housing further comprises, in combination: a cover extending between the first and second sides of the channel and the first and second dividers for defining an interior protected from the environment.

16. The electric circuit actuating mechanism of claim 15 wherein the housing further comprises, in combination: a mount, with the front wall being movably mounted to the mount, with the actuation member being movably mounted to the mount; and means for securing the mount relative to the channel sandwiching the cover against the first and second sides of the channel and against the first and second dividers, with the first and second dividers being sandwiched between the cover and the bottom of the channel.

17. The electric circuit actuating mechanism of claim 16 wherein the movably mounting means comprises, in combination: a multiplicity of coil springs which are arranged in a non-linear manner and sandwiched between the mount and the front wall; and a multiplicity of pins extending from the front wall and slideably received in apertures formed in the mount, with the coil springs positioned around the pins.

18. The electric circuit actuating mechanism of claim 14 wherein the first divider extends between the first and second planar sides parallel to the bottom of the channel; and wherein the electric circuit actuating mechanism further comprises, in combination: an actuator slideably mounted to the first divider for movement between an actuated position and a non-actuated position, with the actuator terminating in the channel; and means mounted to the first divider for movement with the actuator for energizing the electric circuit when the actuator moves from the non-actuated position to the actuated position.

19. The electric circuit actuating mechanism of claim 1 further comprising, in combination: a second switch mounted to the housing, with the first switch de-energizing the electric circuit when the front wall moves in the actuation direction, with the second switch energizing the electric circuit.

20. The electric circuit actuating mechanism of claim 19 wherein at least one of the first and second switches are of the momentary type.

21. The electric circuit actuating mechanism of claim 1 wherein the movably mounting means comprises means for movably mounting the front wall enabling any point of the broad surface to move in the actuation direction from the normal position to the actuation position with the actuation member moving from the rest position towards the de-energizing position when any point of the broad surface moves in the actuation direction from the normal position to the actuation position.

* * * * *